US007983594B2

(12) United States Patent
Hashimoto

(10) Patent No.: US 7,983,594 B2
(45) Date of Patent: Jul. 19, 2011

(54) IMAGE FORMING APPARATUS WITH A DEPOSIT PORTION FOR TONER WASTE DEPOSITS

(75) Inventor: Yohei Hashimoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 425 days.

(21) Appl. No.: 12/171,735

(22) Filed: Jul. 11, 2008

(65) Prior Publication Data

US 2009/0016771 A1 Jan. 15, 2009

(30) Foreign Application Priority Data

Jul. 13, 2007 (JP) ..... 2007-184244

(51) Int. Cl.
*G03G 15/00* (2006.01)

(52) U.S. Cl. ..... 399/110; 399/297; 399/397

(58) Field of Classification Search ..... 399/397, 399/297, 101, 110
See application file for complete search history.

(56) References Cited

U.S. PATENT DOCUMENTS

| | | | | |
|---|---|---|---|---|
| 5,758,252 | A | 5/1998 | Enomoto et al. | |
| 6,061,537 | A * | 5/2000 | Nakajima et al. | 399/107 |
| 7,444,100 | B2 | 10/2008 | Sato | |
| 2002/0025201 | A1 * | 2/2002 | Ohuchi et al. | 399/322 |

FOREIGN PATENT DOCUMENTS

| | | |
|---|---|---|
| JP | 05-216363 | 8/1993 |
| JP | 05-289450 | 11/1993 |
| JP | 05-323814 | 12/1993 |
| JP | 07-319307 | 12/1995 |
| JP | 08-044230 | 2/1996 |
| JP | 09-090685 | 4/1997 |
| JP | 2004-037600 A | 5/2004 |
| JP | 2006-219205 | 8/2006 |
| JP | 2006-209095 A | 10/2006 |

OTHER PUBLICATIONS

Notification of Reasons for Refusal in Japanese Patent Application No. 2007-184244 mailed Jun. 9, 2009 and English translation thereof.

* cited by examiner

*Primary Examiner* — David M Gray
*Assistant Examiner* — Roy Yi
(74) *Attorney, Agent, or Firm* — Banner & Witcoff, Ltd

(57) ABSTRACT

An image forming apparatus configured to effectively prevent a failure in an image is provided. The image forming apparatus of the invention includes a housing, a transport belt for transporting a sheet along a sheet transport face, an image forming portion arranged above the sheet transport face, and a fixing unit arranged on a downstream side of the sheet transport face of the transport belt in a sheet transport direction. The fixing unit includes a heating roller and a pressure roller. A deposit portion where a toner waste deposits is disposed between the image forming portion and the heating roller. The deposit portion is provided with a contact portion that is configured to make contact with an image formation outside region at a trailing edge of the sheet jumping in a direction approaching the heating roller by being separated from the sheet transport face.

10 Claims, 8 Drawing Sheets

IMAGE FORMING APPARATUS WITH A DEPOSIT PORTION FOR TONER WASTE DEPOSITS

CROSS-REFERENCE TO RELATED APPLICATION

This application claims the benefit of Japanese Patent Application No. 2007-184244 filed on Jul. 13, 2007, the content of which is incorporated herein by reference.

BACKGROUND

JP-A-5-289450 discloses an existing image forming apparatus. The image forming apparatus includes a housing, a transport belt arranged in the housing and having a sheet transport face with which a back face of a sheet makes contact and configured to rotate to transport the sheet along the sheet transport face, an image forming portion of an electrophotographic type arranged on an upstream side of the sheet transport face of the transport belt in a sheet transport direction to face a front face side of the sheet in the housing for forming a toner image by transferring a toner on the front face of the sheet, and a fixing unit arranged on a downstream side of the sheet transport face in the sheet transport direction in the housing for fixing the toner image to the sheet.

The fixing unit includes a heating roller driven to rotate in contact with the front face of the sheet, and a pressure roller pressed to the heating roller from the back face side of the sheet for pressing the sheet along with the heating roller.

A partition wall for surrounding the image forming portion is arranged between the image forming portion and the heating roller. Further, the partition wall is provided with a single pair or a plurality of pairs of ribs projected to the sheet transport face. Each pair of ribs are configured to contact both sides of a sheet in a width direction in which the toner image is not formed so as to locate the sheet being transported away from the partition wall and guide it to the fixing unit.

According to the existing image forming apparatus structured above, after the toner image is formed on the front face of the sheet by the image forming portion, the sheet is transported to the fixing unit by the transport belt and the toner image is fixed to the sheet. At that occasion, the ribs guide the transported sheet so as not to make contact with the partition wall, and therefore, a failure in image quality brought about by rubbing the toner image on the front face of the sheet by the partition wall can be prevented.

SUMMARY

An image forming apparatus of the invention comprises a housing, a transport belt arranged in the housing, the transport belt having a sheet transport face brought into contact with a back face of a sheet and being configured to rotate to transport the sheet along the sheet transport face, an image forming portion of an electrophotographic type arranged on a front face side of the sheet transported along the sheet transport face in the housing and being configured to form a toner image on the front face of the sheet with toner, and to keep an image formation outside region which is a region of not forming the toner image on the front face of the sheet, and a fixing unit arranged on a downstream side of the sheet transport face of the transport belt in a sheet transport direction in the housing and being configure to fix the toner image to the sheet. The fixing unit includes a heating roller configured to driven to rotate in contact with the front face of the sheet, and a pressure roller configured to be pressed against the heating roller from the back face side of the sheet and to press the sheet along with the heating roller. A deposit portion where a toner waste deposits is disposed between the image forming portion and the heating roller. The deposit portion is provided with a contact portion, the contact portion is configured to make contact with the image formation outside region at a trailing edge of the sheet jumping in a direction approaching the heating roller by being separated from the sheet transport face.

BRIEF DESCRIPTION OF THE SEVERAL VIEWS OF THE DRAWINGS

Illustrative aspects of the invention will be described in detail with reference to the following figures in which like elements are labeled with like numbers and in which.

DETAILED DESCRIPTION

According to the existing image forming apparatus, toner may be scattered from the image forming portion or an unfixed toner image and adhere to deposit on parts such as the partition wall and the rib as a toner waste. Further, the deposited toner waste may be exfoliated all together from the partition wall and the rib and adhere to a sheet transported successively. In this case, the front face of the sheet may be stained, and a failure in image will occur.

The invention has been carried out in view of an actual situation of the background art and it is a problem to be resolved to provide an image forming apparatus configured to effectively prevent a failure in an image.

An illustrative embodiment of the invention will be described in detail with reference to the accompanying drawings. An image forming apparatus according to aspects of the invention applies to a color laser printer 1. It will be appreciated that aspects of the invention apply to other types of image forming apparatuses as well.

Figure 1:
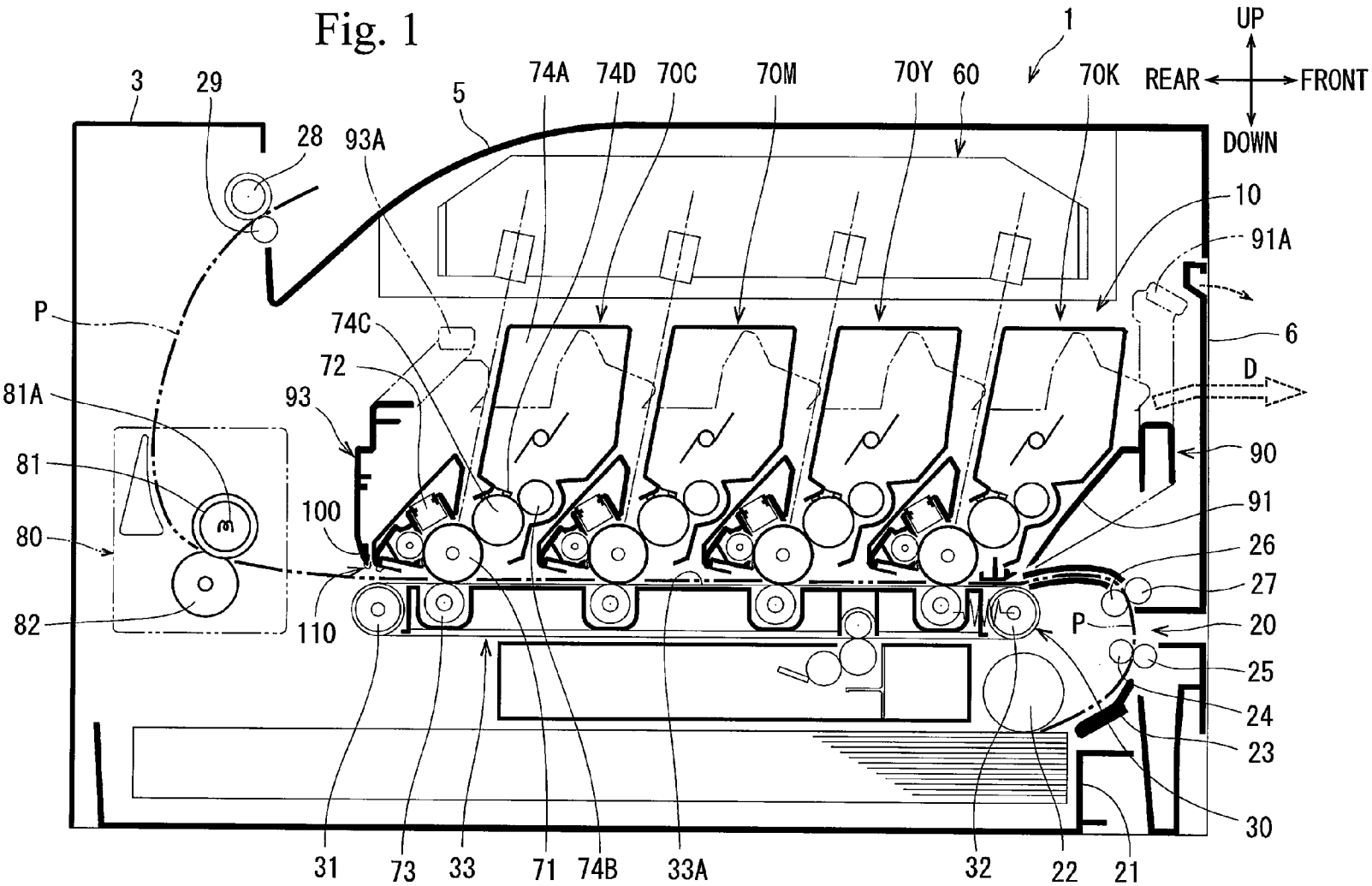
FIG. 1 is a sectional view of an outline of an image forming apparatus according to an illustrative embodiment of the invention.

As shown by FIG. 1, the laser printer 1 is configured to form an image on a recording medium such as a plain paper and a transparency film (hereinafter collectively referred to as a sheet) by an electrophotographic system. In FIG. 1, respective directions of front and rear, left and right and up and down are indicated as viewed from a front side of the laser printer 1 containing a front cover 6 mentioned later (right side in FIG. 1). Further, all of respective directions of front and rear, left and right and up and down shown in FIG. 2 through FIG. 7 correspond to the respective directions shown in FIG. 1.

The laser printer 1 includes a feeder portion 20, a transport mechanism 30, an image forming portion 10, a fixing unit 80 and a drawer case 90 at inside of a generally box-shaped housing 3.

On the other hand, a top face side of the housing 3 is provided with an ejection tray 5 on which a sheet having an image thereon is ejected from the housing 3 and placed. A front face of the housing 3 is provided with the front cover 6 capable of being opened and closed by constituting a pivoting center axis by a bottom end side. The front cover 6 is opened by a user when the drawer case 90 mentioned later is stored in or removed from inside of the housing 3. Respective constituent elements of the laser printer 1 will be explained in details as follows.

1. Feeder Portion

As shown by FIG. 1, the feeder portion 20 includes a sheet feed tray 21 stored in a bottom most portion of the housing 3, a sheet feed roller 22 provided above the sheet feed tray 21 at a front end thereof for feeding (transporting) the sheet in the sheet feed tray 21 to the image forming portion 10, a separation pad 23 for separating the sheets fed by the sheet feed roller 22 sheet by sheet by applying a predetermined transport resistance to the sheet.

Transport rollers 24 and 25 are disposed above the separation pad 23 along a sheet transport path P (indicated by a bold two-dotted chain line in FIG. 1) turning frontward substantially in a U-like shape. The transport rollers 24 and 25 are configured to apply a transport force to the sheet transported to the image forming portion.

Registration rollers 26 and 27 are disposed at a downstream side of the transport rollers 24 and 25 in a direction where the sheet is transported (hereinafter referred to as a sheet transport direction. The sheet transport direction is a direction to the ejection tray 5 along the sheet transport Path P.). The registration rollers 26 and 27 are configured to correct skewing of the sheet by making contact with a leading end of the sheet transported by the transport rollers 24 and 25, and to transport the sheet further to the image forming portion 10.

2. Transport Mechanism

The transport mechanism 30 includes a transport belt 33 arranged between the sheet feed tray 21 on a bottom side and the image forming portion 10 on a top side, and ejection rollers 28 and 29 arranged on the most downstream side of the sheet transport path P and immediately before the ejection tray 5.

The transport belt 33 is wound between a drive roller 31 disposed on a rear end side under the image forming portion 10 and a driven roller 32 disposed on a front end side under the image forming portion 10. Further, the transport belt 33 is configured to rotate between the drive roller 31 and the driven roller 32 when the drive roller 31 is rotated in connection with the feeder portion 20, the image forming portion 10 and the fixing unit 80. An upper surface of the transport belt 33 wound to the drive roller 31 and the driven roller 32 is arranged substantially horizontally right below the image forming portion 10. The upper surface of the transport belt 33 functions as a sheet transport face 33A for transporting a sheet in contact with the back face of the sheet.

Figure 2:
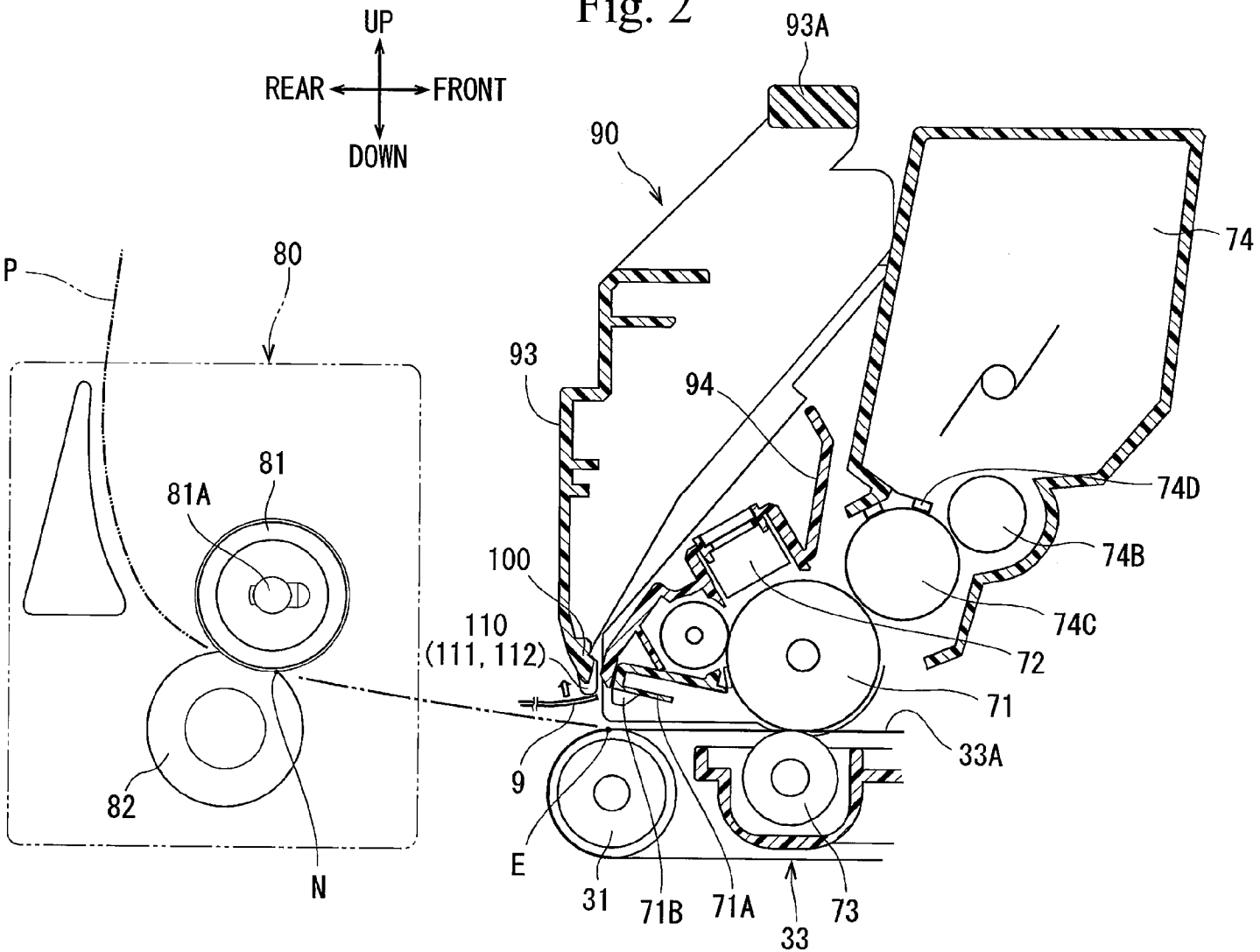
FIG. 2 is a sectional view enlarging an essential portion of the image forming apparatus of the embodiment.

A transfer roller 73 is disposed in contact with a bottom side of the sheet transport face 33A from below. The transport belt 33 is made of conductive rubber. The transport belt 33 is charged by negative charge applied to the transfer roller 73. Thereby, the transport belt 33 is made to be able to transfer the sheet along the sheet transport face 33A while bringing the back face of the sheet into contact with the sheet transport face 33A by adsorbing the sheet by an electrostatic force. Therefore, as shown by FIG. 2, a trailing edge of the sheet is brought into close contact with the transport belt 33 up to a terminal end of the sheet transport face 33A. A position where the trailing edge of the sheet separates from the transport belt 33 is referred to as a transport terminal end position E.

As shown by FIG. 1, the transport mechanism 30 structured above successively transports the sheet transported from the feeder portion 20 to the image forming portion 10 and the fixing unit 80 along the sheet transport path P as the transport belt 33 rotates with the sheet loaded thereon. Further, the sheet formed with the image is ejected to the ejection tray 5 by the ejection rollers 28 and 29.

3. Image Forming Portion

As shown by FIG. 1, the image forming portion 10 includes a scanner portion 60, four process cartridges 70K, 70Y, 70M, and 70C and the transfer roller 73. The scanner portion 60 is arranged on a topmost side of inside of the housing 3. The four process cartridges 70K, 70Y, 70M, and 70C are stored at inside of the drawer case 90 mentioned later and aligned from an upstream side to a downstream side of the sheet transport face 33A in the sheet transport direction. The transfer roller 73 is arranged on a bottom side of the sheet transport face 33A of the transport belt 33.

3. 1. Scanner Portion

The scanner portion 60 includes a laser light source, a polygonal mirror, an fθ lens and reflective mirrors.

A laser beam emitted from the laser light source is deflected by the polygonal mirror, passes through the fθ lens, thereafter, is folded back in an optical path thereof by the reflective mirrors, further, by bending the optical path to the bottom side by the reflective mirrors, irradiated onto surfaces of photosensitive drums 71 respectively provided at the four process cartridges 70K, 70Y, 70M, and 70C to form an electrostatic latent image.

3. 2. Process Cartridge

The four process cartridges 70K, 70Y, 70M, and 70C are identical in structure, but with different colors of toner as colorants. Thus, in the following description, the structure will be described by using the process cartridge 70C as an example.

The process cartridge 70C includes the photosensitive drum 71, a charger 72 and a toner cartridge 74 which are well-known.

The toner cartridge 74 includes a toner containing compartment 74A containing the toner, a development roller 74C and a feed roller 74B for feeding the toner to the development roller 74C. Further, the toner contained in the toner containing compartment 74A is fed to the development roller 74C along with the rotation of the feed roller 74B. The toner fed to the development roller 74C is carried by the surface of the development roller 74C, regulated to a uniform thickness by a layer thickness regulation blade 74D, and fed to the surface of the photosensitive drum 71.

3. 3. Transfer Roller

The transfer roller 73 is arranged rotatably on a side of the sheet transport face 33A opposite the photosensitive drum 71. The transfer roller 73 is applied with a transfer bias for transferring the toner adhered to the surface of the photosensitive drum 71 to the sheet when the sheet passes through a vicinity of the photosensitive drum 71.

4. Fixing Unit

As shown by FIG. 1, the fixing unit 80 is arranged on the downstream side of the sheet transport path P relative to the image forming portion 10. Further, the fixing unit 80 includes a heating roller 81 and a pressure roller 82.

4. 1. Heating Roller

As shown in FIG. 2, the heating roller 81 is a cylindrical rotating member made of a metal, and arranged such as to face the front face side of the sheet. The heating roller 81 is entirely heated to about 200° C. by a halogen lamp heater 81A arranged on an inner cylinder side.

The heating roller 81 has an inverted crown shape in which an outer diameter of a center of the heating roller 81, in a width direction of the sheet, is smaller than an outer diameter of each end for smoothing creases in the sheet (specifically, the outer diameter of the center is smaller than that of each end by about 0.1 mm).

The heating roller 81 is driven to rotate in synchronism with the development roller 74C, the photosensitive drum 71 and the transport belt 33 during an image forming operation mentioned later.

4. 2. Pressure Roller

As shown in FIG. 2, the pressure roller 82 is arranged on a side of the sheet transport path P opposite the heating roller 81. The pressure roller 82 is a cylindrical rotating member integrating a roller made of heat resistant rubber to a rotating shaft made of a metal. The pressure roller 82 is pressed to the heating roller 81 by a predetermined press force and is driven to rotate in a direction reverse to that of the heating roller 81 by receiving a rotational force from the heating roller 81 by way of the sheet brought into contact with the heating roller 81.

At this occasion, the pressure roller 82 is deformed to be recessed in a circular arc shape by being pressed by the heating roller 81, and therefore, the sheet nipped by the heating roller 81 and the pressure roller 82 tends to be curved in a circular arc shape to be along the heating roller 81. Therefore, when a trailing edge 9 of the sheet shown in FIG. 2 passes through the transport terminal end position E and is separated from the transport belt 33, the trailing edge 9 of the sheet tends to jump in a direction approaching the heating roller 81. A position where the heating roller 81 and the pressure roller 82 start to press the sheet is referred to as a nip start position N.

As shown by FIG. 2, the nip start position N is disposed closer to the front face side of the sheet rather than the back face side relative to the sheet transport face 33A. Therefore, the trailing edge 9 of the sheet is brought into a state of being bent in the direction remote from the heating roller 81 immediately before the transport terminal end position E. When the trailing edge 9 of the sheet is separated from the transport belt 33, the sheet tends to jump in the direction approaching the heating roller 81 (the front face side of the sheet).

As the heating roller 81 has the inverted crown shape, the sheet nipped by the heating roller 81 and the pressure roller 82 is smoothed and strongly tends to be straight before and after the nip range. Therefore, the trailing edge 9 of the sheet tends to jump further.

As shown by FIG. 2, an axis center of the pressure roller 82 is disposed on the downstream side of an axis center of the heating roller 81 in the sheet transport direction. Thereby, the sheet is transported in a state of being bent toward the heating roller 81 after passing the fixing unit 80, and therefore, the sheet transport path P can be made short and the laser printer 1 can be downsized.

The fixing unit 80 structured above can cause the heating roller 81 and the pressure roller 82 to fix the toner transferred to the sheet by heat fusion and transport the sheet to the downstream side of the sheet transport path P.

5. Summary of Image Forming Operation

In the laser printer 1 of the embodiment structured above, an image is formed on a sheet as follows. When an image forming operation is started, the feeder portion 20 and the transport mechanism 30 are operated so that the sheet is transported to the image forming portion 10, and the scanner portion 60 and the process cartridges 70K, 70Y, 70M, 70C of the image forming portion 10 are operated. Therefore, the surface of each photosensitive drum 71 is uniformly charged positively by the corresponding charger 72 in accordance with rotation of the photosensitive drum 71, and exposed by the laser beam irradiated from the scanner portion 60. As a result, the surface of each photosensitive drum 71 is formed with an electrostatic latent image in correspondence with an image forming data.

Next, as the development roller 74C rotates, the toner carried on the development roller 74C and positively charged is fed to the electrostatic latent image formed on the surface of each photosensitive drum 71 when it is opposed to and brought into contact with the photosensitive drum 71. Thereby, the electrostatic latent image of the photosensitive drum 71 is visualized and a toner image by reversal is carried on the surface of the photosensitive drum 71.

Figure 8:
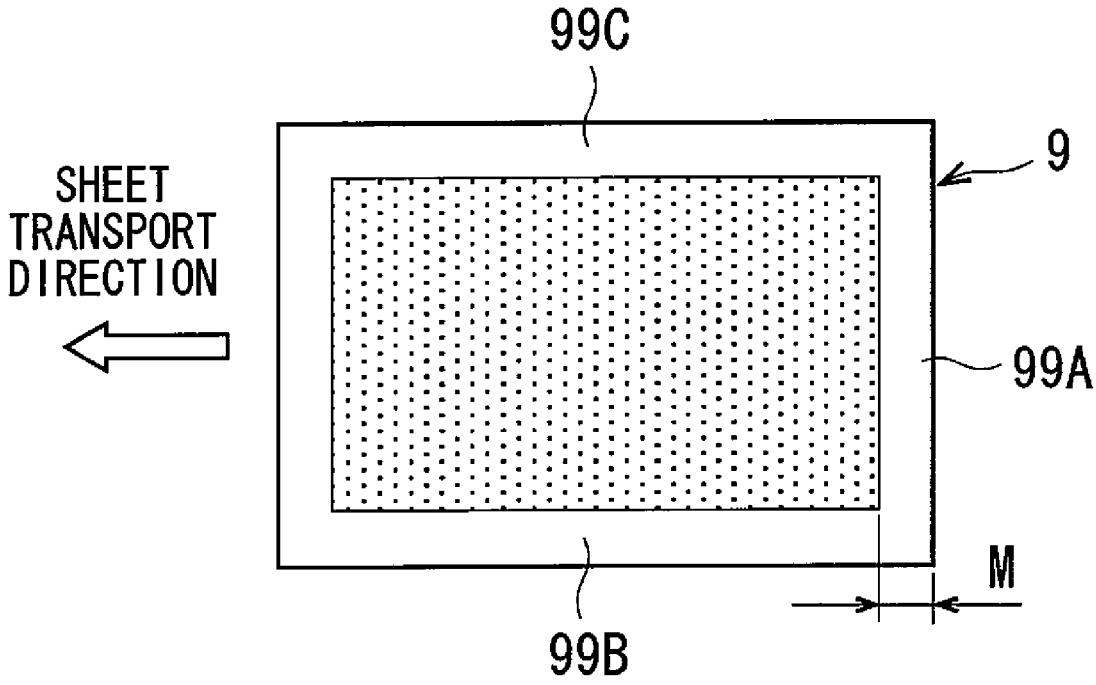
FIG. 8 shows an image formation outside region at a trailing edge of a sheet.

Thereafter, the toner image carried on the surface of each photosensitive drum 71 is transferred to the sheet by the transfer bias applied to the transfer roller 73. Further, the sheet on which the toner image is transferred is transported to the fixing unit 80 and heated and pressed by the heating roller 81 and the pressure roller 82, and the toner transferred as the toner image is fixed to the sheet. Finally, the sheet with the image formed is ejected to the ejection tray 5, and the image forming operation is completed. At this occasion, the image forming portion 10 keeps an image formation outside region which is a region of not forming the toner image on the front face of the sheet (for example, image formation outside regions 99A, 99B, and 99C as shown by FIG. 8).

6. Drawer Case

The laser printer 1 of the embodiment for carrying out the image forming operation as described above is provided with the drawer case 90 for facilitating interchange or maintenance of the process cartridges 70K, 70Y, 70M, and 70C constituting the image forming portion 10.

As shown by FIG. 1, the drawer case 90 includes the process cartridges 70K, 70Y, 70M, and 70C. The drawer case 90 is attachably and detachably stored inside the housing 3 with the process cartridges 70K, 70Y, 70M, and 70C.

As shown by FIG. 3 through FIG. 6, the drawer case 90 as a single member includes a front wall 91 on a front side, left and right side walls 92A and 92B and a protection wall 93 on a rear side, which are combined to shape a frame of which top and bottom sides are opened.

Handles 91A and 93A are projected upward from top end edges of the front wall 91 and the protection wall 93. The handles 91A and 93A are provided for a user to grasp when the drawer case 90 is attached to and detached and from the housing 3.

Figure 4:
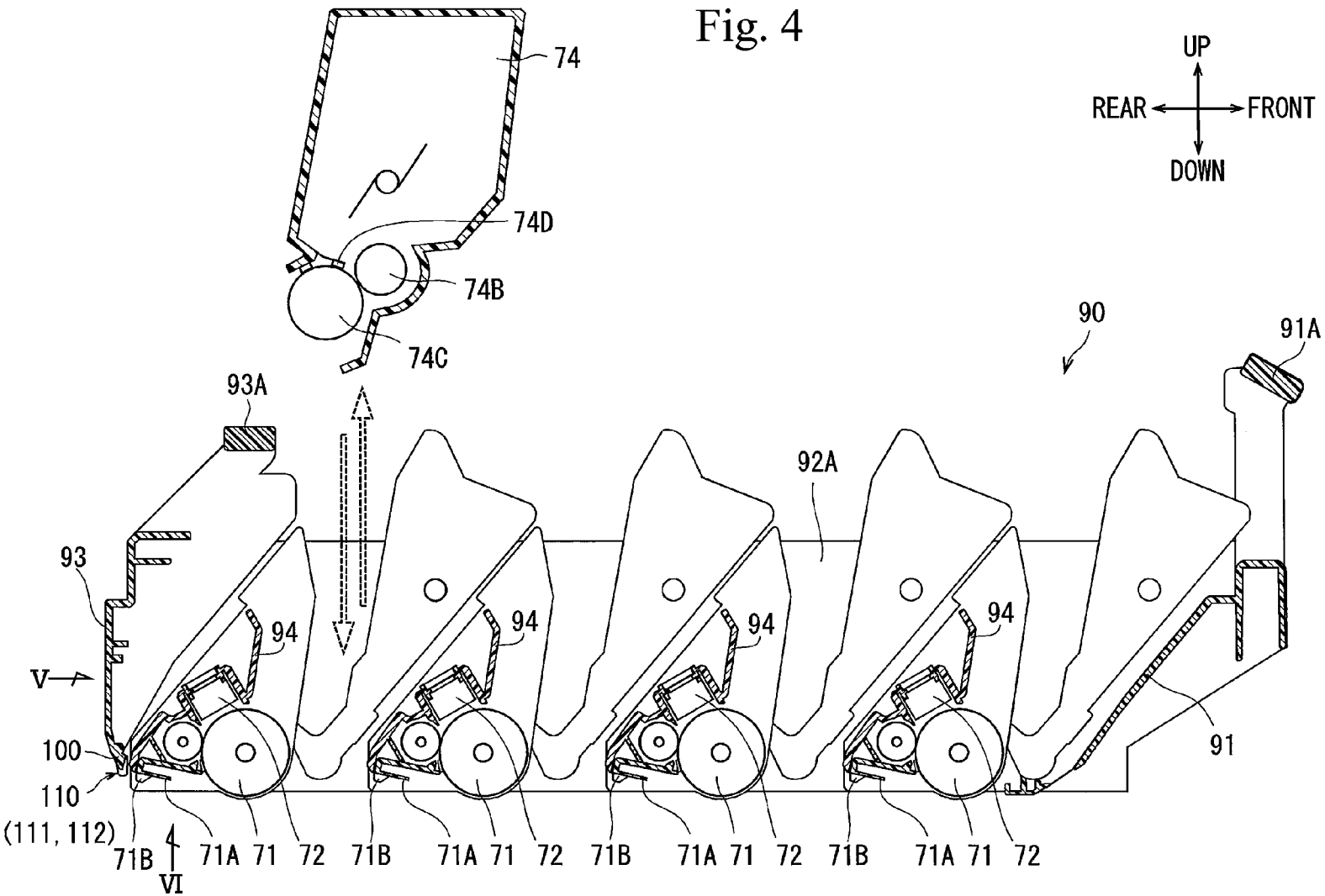
FIG. 4 is an schematic sectional view along a line IV-IV of FIG. 3.

As shown by FIG. 4, at inside of the drawer case 90, the photosensitive drums 71 and the chargers 72 constituting the process cartridges 70K, 70Y, 70M, and 70C are integrally supported and fixed by way of four frame members 94 connected to the left and right side walls 92A and 92B. The respective photosensitive drums 71 are aligned in a front and rear direction of the drawer case 90 and aligned from the upstream side to the downstream side of the sheet transport face 33A in the sheet transport direction when the drawer case 90 is stored inside of the housing 3. Further, the photosensitive drums 71 and the chargers 72 are interchanged along with the drawer case 90 as expendables.

As shown by FIG. 4, each toner cartridge 74 included in the corresponding process cartridge 70K, 70Y, 70M, and 70C can be contained to inside of the drawer case 90 by being inserted from above to between the corresponding frame member 94 and the front wall 91 and the toner cartridge 74 can be detached by being pulled upward from the drawer case 90. Thereby, when the toner in the toner cartridge 74 is consumed, the toner cartridge 74 can be replaced with a new one thereof.

Figure 6:
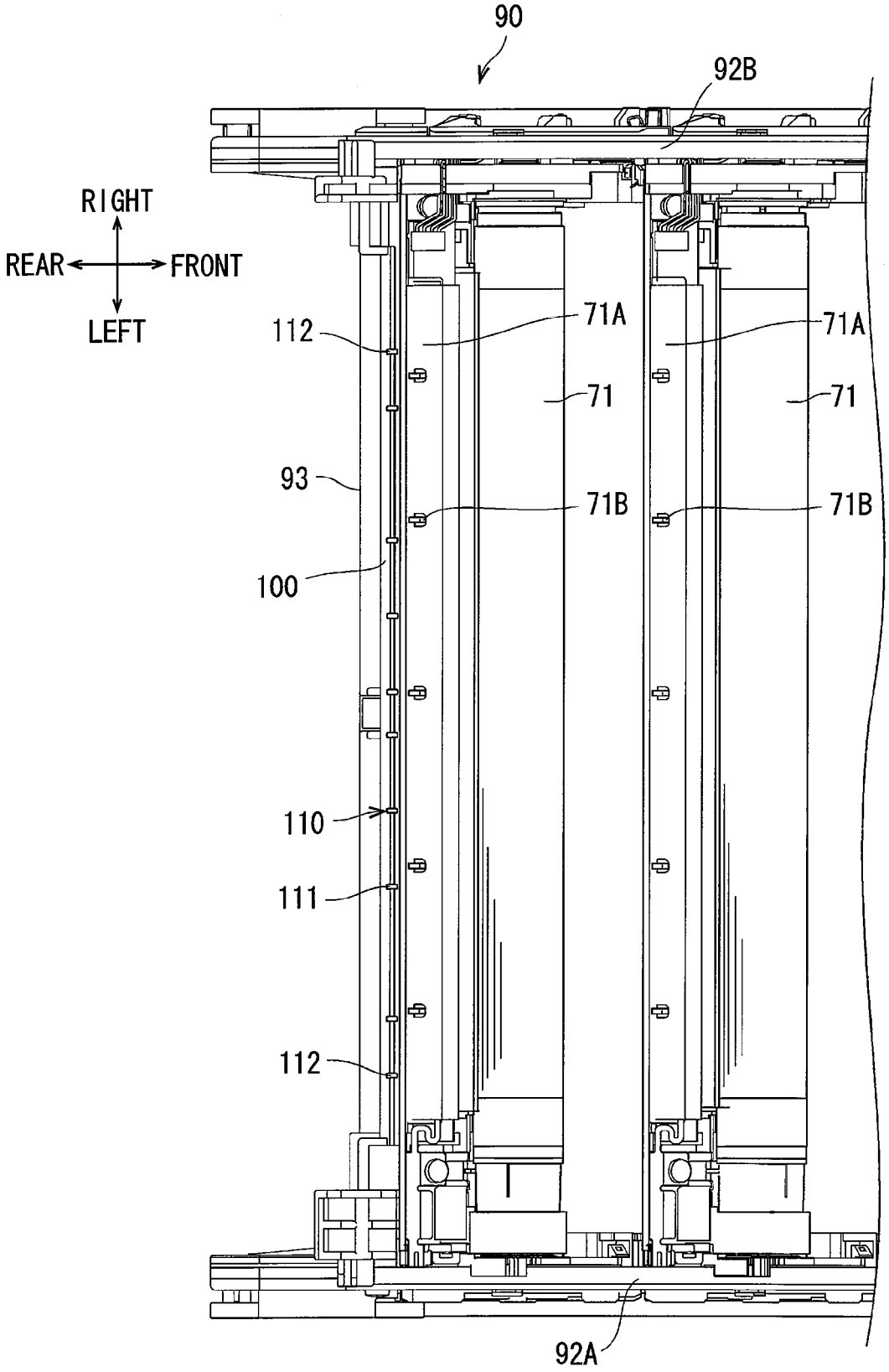
FIG. 6 is a bottom view viewed in a direction of an arrow VI of FIG. 4.

A rear side of each of the photosensitive drums 71 is arranged with a plate member 71A constituting the frame member 94 for holding the photosensitive drum 71 and the charger 72. As shown by FIG. 6, a back side of the plate member 71A includes a plurality of projections 71B, which are projected downward and spaced apart from each other by predetermined intervals in a left and right direction.

The projections 71B are configured to prevent the sheet from tightly contacting the back side of the plate member 71A such that the toner image on the front surface of the sheet does not adhere to the back side of the plate member 71A even when the sheet electrostatically attracted to and transported on the sheet transport face 33A comes off the sheet transport face 33A by a rare drawback such as jamming and buckling.

As shown by FIG. 1 and FIG. 2, when the drawer case 90 is contained in the housing 3, the protection wall 93 is disposed between the image forming portion 10 and the heating roller 81 to block the heat therebetween. Thus, the protection wall 93 is configured to prevent an adverse influence by heat on the image forming portion 10. Therefore, the protection wall 93 is made from a heat resistant resin capable of withstanding even a high temperature of about 200° C. In order to firmly block the heat, a bottom side end edge of the protection wall 93 is extended to be proximate to the sheet transport face 33A.

As shown by FIG. 1, the drawer case 90 structured above is detached from the housing 3 by being drawn in D direction when the front cover 6 is opened. Further, the drawer case 90 is contained inside of the housing 3 by being inserted in a direction reverse to D direction. In this way, interchange or maintenance of the process cartridges 70K, 70Y, 70M, and 70C provided in the drawer case 90 can be easily carried out.

According to the laser printer 1 of the embodiment, as shown in FIG. 2, every time the sheet is transported by the image forming operation, toner is likely to be separated from the image forming portion 10 or an unfixed toner image, and adhere and deposit to the bottom side of the protection wall 93 as a toner waste. A portion of the bottom side of the protection wall 93 at which the toner waste is likely to deposit is a deposit portion 100 of the embodiment.

In the laser printer 1, a contact portion 110 is disposed at the deposit portion 100 to prevent toner waste from depositing in the deposit portion 100. As shown in FIG. 2, when the trailing edge 9 of the sheet separates from the sheet transport face 33A and jumps in the direction approaching the heating roller 81, the contact portion 110 makes contact with an image formation outside region 99A of the trailing edge 9 of the sheet at which the toner image is not formed as shown by FIG. 8 (at a rear side with respect to the sheet transport direction indicated by an arrow mark in the drawing). In FIG. 8, a shaded region represents a region at which the toner image is formed. The contact portion 110 will be described in details as follows.

7. Contact Portion

Figure 3:
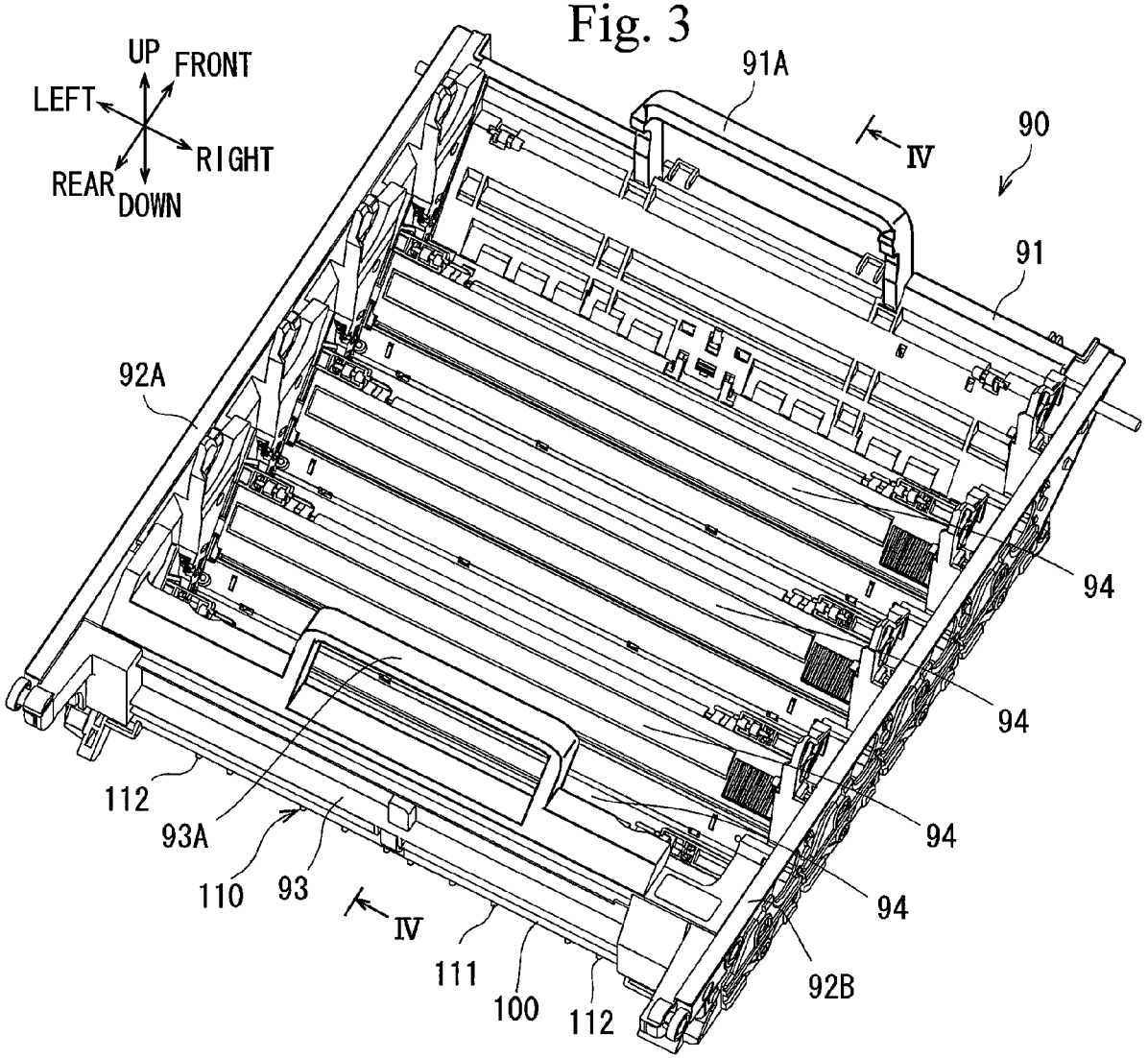
FIG. 3 is a perspective view showing a drawer case of the image forming apparatus of the embodiment.
Figure 5:
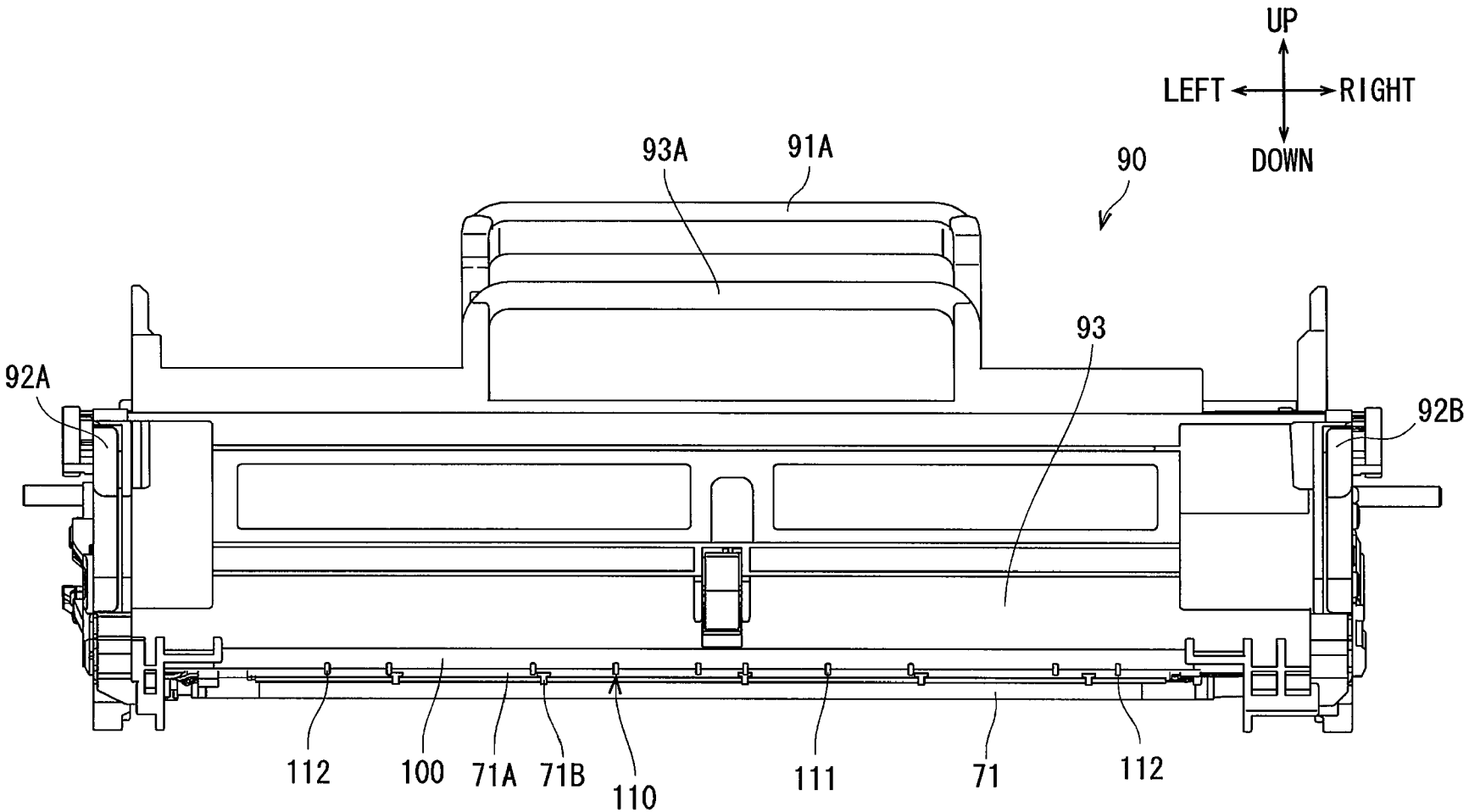
FIG. 5 is a rear view viewed in a direction of an arrow V of FIG. 4.

As shown by FIG. 2, the contact portion 110 includes ribs 111 and 112 integrally molded to project downward from the lower edge of the protection wall 93. Heights of lower end faces of the respective ribs 111 and 112 constituting faces making contact with the sheet are the same. Further, as shown by FIG. 3, FIG. 5 and FIG. 6, the ribs 111 and 112 are spaced apart from each other by predetermined intervals therebetween in the left and right direction. The ribs disposed on both sides in the left and right direction are the end portion ribs 112, and arranged to make contact with the sheet at image formation outside regions 99B and 99C disposed on both sides of the sheet in a width direction of the sheet as shown by FIG. 8. The other ribs constitute middle ribs 111.

The arrangement of the contact portion 110 is determined by setting two ranges as follows in order to firmly achieve an effect of the invention.

Figure 7:
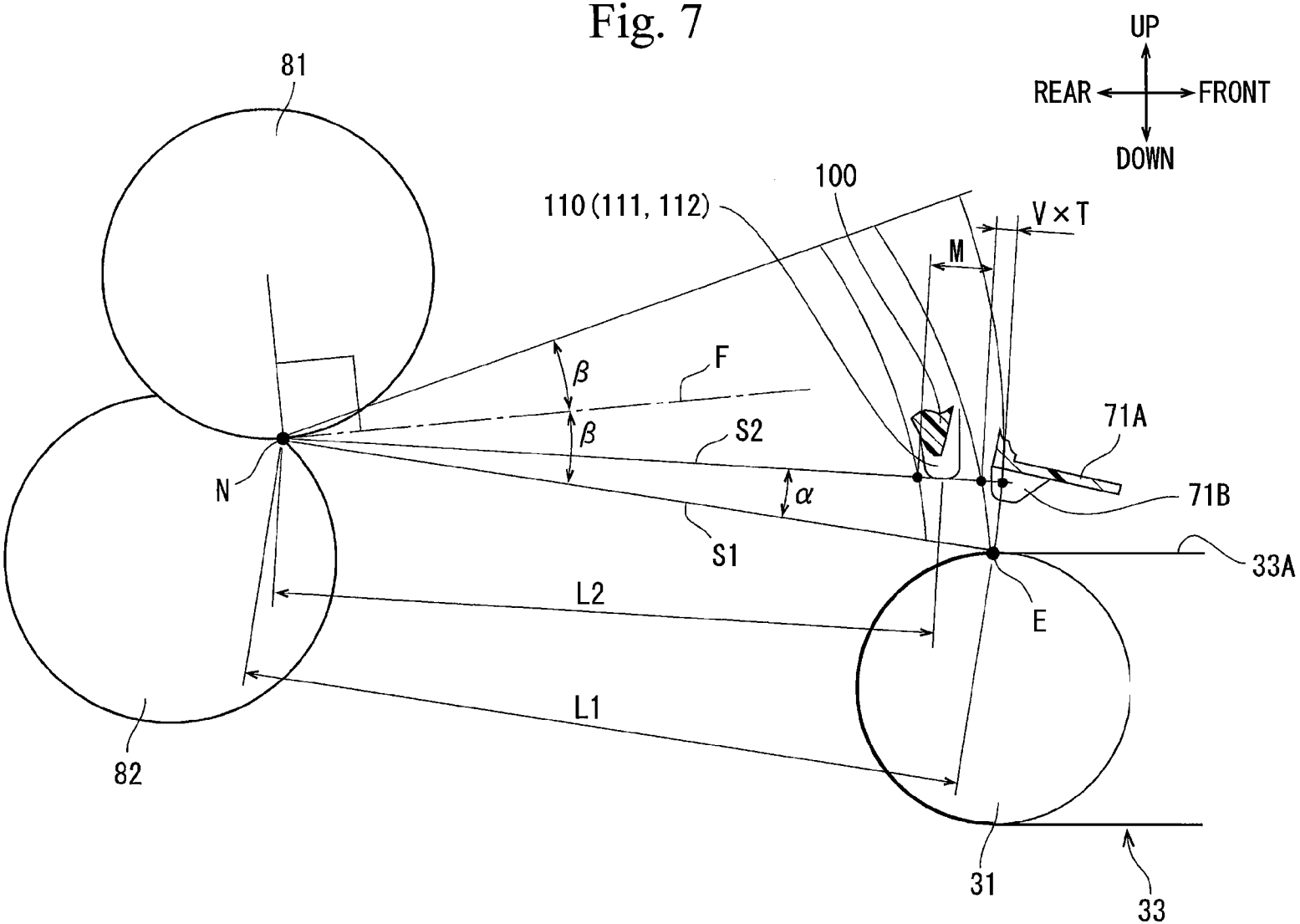
FIG. 7 shows an arrangement of a contact portion.

First, a first range setting will be explained. As shown by FIG. 7, an angle made by a straight line S1 connecting the nip start position N and the transport terminal end position E and a straight line S2 connecting the nip start position N and the lower end face of the rib 111 or 112 as the contact portion 110 is defined as $\alpha$ (°).

An angle made by a tangential line F of the heating roller 81 at the nip start position N and the straight line S1 connecting the nip start position N and the transport terminal end position E is defined as $\beta$ (°).

In this case, as shown by FIG. 7, the angle $\alpha$ is set in a range of $0<\alpha<2\times\beta$. The angle $\alpha$ is set in this way by a reason described below.

That is, when the trailing edge 9 of the sheet is separated from the transport belt 33, the trailing edge 9 pivoted about the nip start position N shows a behavior as if the swing of a cantilever decays in a comparatively short period of time (for example, about several ten milliseconds through several hundred milliseconds). The tangential line F of the heating roller 81 at the nip start position N can be regarded as a neutral position when the trailing edge 9 of the sheet is pivoted about the nip start position N. Further, when the trailing edge 9 of the sheet is separated from the transport belt 33 at the transport terminal end position E, the trailing edge 9 is bent by the angle $\beta$ toward the back face side of the sheet from the tangential line F as the neutral position, and therefore, the trailing edge 9 of the sheet jumping toward the front face side of the sheet can be pivoted further by about the angle $\beta$ over the tangential line F. Therefore, by setting the range as $0<\alpha<2\times\beta$, the trailing edge 9 of the sheet can be easily brought into contact with the contact portion 110. Further, according to the embodiment, in order to bring the trailing edge 9 of the sheet into contact with the contact portion 110 further firmly, the range of the angle $\alpha$ is narrowly set to $0<\alpha<\beta$.

Next, a second range setting will be explained. As shown by FIG. 7, a distance between the nip start position N and the transport terminal end position E is defined as L1 (mm) and a distance between the nip start position N and the lower end face of the rib 111 or 112 as the contact portion 110 is defined as L2 (mm).

A time period in which the trailing edge 9 of the sheet is pivoted by the angle $\alpha$ after it is separated from the transport belt 33 is defined as T (second). Here, the time period T is the comparatively short period of time (for example, about several ten milliseconds through several hundred milliseconds) and influenced also by the distance L2 between the nip start position N and the contact portion 110, and a material or a thickness of the sheet. According to the embodiment, the time period T is about several ten milliseconds.

A speed of transporting the sheet is defined as V (mm/second). Although the transport speed V differs among printer models, the transport speed V is about several ten mm/second according to the laser printer 1 of the embodiment.

A length in the sheet transport direction of the image formation outside region 99A at the trailing edge 9 of the sheet is defined as M (mm) (shown in FIG. 8). Although the length M differs among printer models, the length M is about 3 mm in the laser printer 1 of the embodiment.

In this case, as shown by FIG. 7, the distance L2 is set to a range of $L1-V\times T-M<L2<L1-V\times T$. In this way, by predicting a locus when the trailing edge 9 of the sheet moving at the transport speed V is separated and jumps from the transport belt 33, the contact portion 110 is arranged in the range.

As the arrangement of the contact portion 110 is determined by setting the two ranges described above, the trailing edge 9 of the sheet can be reliably brought into contact with the contact portion 110.

As shown by FIG. 7, the projection 71B is arranged at a position at which the projection 71B does not absolutely make contact with the trailing edge 9 of the sheet so far as the trailing edge 9 of the sheet is separated from the transport belt 33 at the transport terminal end position E. Therefore, a function of the projection 71B differs from that of the contact portion 110.

As has been explained above, according to the laser printer 1 of the embodiment, on the bottom side of the protection wall 93 provided between the image forming portion 10 and the heating roller 81, there is present the deposit portion 100 at which the toner waste separated from the image forming portion 10 or the unfixed toner image can be deposited.

Further, by the arrangement of the transport belt 33 and the fixing unit 80, at each time of forming the image, the trailing edge 9 of the sheet is separated from the transport belt 33 and jumps in the direction approaching the heating roller 81.

Further, the deposit portion 100 of the protection wall 93 is provided with the contact portion 110 that makes contact with the image formation outside region 99A when the trailing edge 9 of the sheet is separated from the sheet transport face 33A and jumps in the direction approaching the heating roller 81.

Therefore, at each time of forming the image, the contact portion 110 makes contact with the image formation outside region 99A at the trailing edge 9 of the sheet, so that the deposit portion 100 is oscillated by the contact. Therefore, the toner waste is prevented from depositing on the deposit portion 100. As a result, according to the laser printer 1, a drawback, e.g., a stain on a sheet by the deposited toner waste can be prevented.

Even when the toner waste slightly deposits at the contact portion 110, the contact portion 110 makes contact with the image formation outside region 99A on the trailing edge 9 of the sheet, and the toner waste depositing at the contact portion 110 is cleaned by the trailing edge 9 of the sheet without disturbing the toner image.

Further, the toner waste separated by contact between the contact portion 110 and the trailing edge 9 of the sheet at each time when the sheet passes is comparatively small. Even when the toner waste adheres to the sheet, it is difficult for a user to recognize the toner waste as a failure in the image.

Therefore, the laser printer 1 of the embodiment can effectively prevent image failure from occurring.

Further, according to the laser printer 1, the image forming portion 10 is provided at the drawer case 90 attachably and detachably contained inside the housing 3, and the protection wall 93 of the drawer case 90 is formed with the deposit portion 100 and the contact portion 110.

Therefore, the laser printer 1 can easily be provided with the contact portion 110 by improving the drawer case 90. Further, the drawer case 90 is a consumable, and therefore, even when the contact portion 110 is worn, the contact portion 110 can be interchanged along with the drawer case 90.

Further, the protection wall 93 blocks the heat of the heating roller 81 against the image forming portion 10, and therefore, the protection wall 93 is arranged to be proximate to the transported sheet and the toner waste is apt to deposit at the deposit portion 100 of the protection wall 93. By providing the contact portion 110 at the deposit portion 100 of the protection wall 93, the laser printer 1 can firmly enjoy operation and effect of the invention.

Further, according to the laser printer 1, the contact portion 110 includes the ribs 111 and 112. Therefore, an area where the contact portion 110 makes direct contact with the trailing edge 9 of the sheet can be made small, and therefore, the toner waste is unlikely to deposit at the contact portion 110 per se. Further, the deposit portion 100 can be located away from the sheet, and therefore, the toner waste is further prevented from depositing at the deposit portion 100. As a result, the laser printer 1 can further firmly achieve operation and effect of the invention.

Further, in the laser printer 1, the contact portion 110 includes the end portion ribs 112 that make contact with the image formation outside regions disposed at both sides of the sheet in the width direction of the sheet, and therefore, the sheet can be prevented from being stained in a wide range.

Further, in the laser printer 1, the heights of the lower end faces of the respective ribs 111 and 112 that make contact with the sheet are the same, and therefore, the respective ribs 111 and 112 can substantially uniformly make contact with the trailing edge 9 of the sheet.

Further, in the laser printer 1, the transport belt 33 is configured to attract the sheet by the electrostatic force, and the nip start position N is disposed closer to the front face side of the sheet rather than the back face side of the sheet relative to the sheet transport face 33A. Therefore, the trailing edge 9 of the sheet is firmly maintained in contact with the transport belt 33 by the electrostatic force until it reaches the transport terminal end position E. Further, since the nip start position N is disposed closer to the front face side of the sheet rather than the back face side of the sheet relative to the sheet transport face 33A, immediately before the trailing edge 9 of the sheet is separated from the transport belt 33, the trailing edge 9 of the sheet is bent in a direction remote from the heating roller 81 (back face side of the sheet). Therefore, when the trailing edge 99 of the sheet is separated from the transport belt 33, the trailing edge 99 tends to jump in a direction approaching the heating roller 81 (toward the front face side of the sheet). Therefore, according to the laser printer 1, the contact portion 110 is apt to make contact with the trailing edge 9 and operation and effect of the invention are further firmly obtained.

Further, in the laser printer 1, the drawer case 90 includes the photosensitive drums 71 aligned from the upstream side to the downstream side of the sheet transport face 33A in the sheet transport direction. When the photosensitive drums 71 are aligned, the toner waste is likely to occur, and the toner waste is likely to deposit particularly at the deposit portion 100 of the protection wall 93 disposed on the downstream side of the sheet transport face 33A in the sheet transport direction. However, according to the laser printer 1, the contact portion 110 can prevent the toner waste from depositing at the deposit portion 100.

Although as described above, the invention has been explained based on the embodiment, the invention is not restricted by the embodiment but can naturally be applied by being pertinently changed within the range not deviated from the gist.

The deposit portion and the contact portion can be constituted by the housing or other constituent part. The contact portion may be of any type so far as the contact portion can achieve operation and effect of the invention. For example, the contact portion may be extended continuously in the width direction of the sheet or may include a plurality of projected ribs.

Operation and effect of the invention are achieved even when a frequency where the contact portion makes contact with the image formation outside region at the trailing edge of the sheet is not 100%. For example, the toner waste can be prevented from depositing at the deposit portion even when the contact portion makes contact with the trailing edge of the sheet at a rate of once every several times.

The invention can be utilized in the image forming apparatus.

What is claimed is:

1. An image forming apparatus comprising:

a housing;

a transport belt arranged in the housing, the transport belt having a sheet transport face configured to be brought into contact with a back face of a sheet and being configured to rotate to transport the sheet along the sheet transport face;

an image forming portion of an electrophotographic type configured to engage a front face side of the sheet transported along the sheet transport face in the housing, the image forming portion being configured to form a toner image on the front face of the sheet, and to define on the front face of the sheet an image formation outside region in which the toner image is not formed;

a fixing unit arranged in the housing at a downstream side of the sheet transport face of the transport belt in a sheet transport direction and configured to fix the toner image to the sheet; and a deposit portion configured to receive toner waste deposits, wherein the fixing unit includes a heating roller configured to be driven to rotate in contact with the front face of the sheet, and a pressure roller configured to press against the heating roller from the back face side of the sheet and to press the sheet along with the heating roller, wherein the deposit portion is disposed between the image forming portion and the heating roller, wherein the deposit portion is provided with a contact portion, the contact portion is configured to make contact with a portion of the image formation outside region at a trailing edge of the sheet that moves in a direction towards the heating roller by being separated from the sheet transport face of the transport belt, wherein the transport belt is configured to attract the sheet by an electrostatic force; and wherein a nip start position where the heating roller and the pressure roller start to press the sheet is disposed closer to the front face side of the sheet rather than the back face side of the sheet relative to the sheet transport face, wherein relative to a width direction of the sheet;

an angle made by a straight line connecting the nip start position and a transport terminal end position at which the trailing edge of the sheet is separated from the transport belt and a straight line connecting the nip start position and the contact portion is defined as $\alpha$; and an angle made by a tangential line of the heating roller at the nip start position and the straight line connecting the nip start position and the transport terminal end position is defined as $\beta$;

the angle $\alpha$ is set to a range of $0<\alpha<2\times\beta$.

2. The image forming apparatus according to claim 1, comprising a drawer case detachably contained in the housing, wherein the image forming portion includes constituent elements, at least portions of the constituent elements are provided at the drawer case, and the drawer case includes the deposit portion and the contact portion.

3. The image forming apparatus according to claim 2, wherein the drawer case includes a protection wall disposed between the image forming portion and the heating roller and the protection wall is configured to block heat therebetween; and wherein the deposit portion and the contact portion are provided at the protection wall.

4. The image forming apparatus according to claim 3, wherein the contact portion comprises a plurality of ribs.

5. The image forming apparatus according to claim 4, wherein the ribs include end ribs configured to make contact with portions of the image formation outside region disposed at both sides of the sheet in a width direction of the sheet.

6. The image forming apparatus according to claim 4, wherein heights of the ribs making contact with the sheet are the same.

7. The image forming apparatus according to claim 1, wherein relative to the width direction of the sheet;

a distance between the nip start position and the transport terminal end position is defined as L1;

a distance between the nip start position and the contact portion is defined as L2;

a time period during which the trailing edge of the sheet is separated from the transport belt and pivoted by the angle $\alpha$ is defined as T;

a speed of transporting the sheet is defined as V; and a length in the sheet transport direction of the image formation outside region at the trailing edge of the sheet is defined as M;

the distance L2 is set to a range of $L1-V\times T-M<L2<L1-V\times T$.

8. The image forming apparatus according to claim 1, wherein the heating roller has an inverted crown shape in which an outer diameter thereof at a center in the width direction of the sheet is smaller than an outer diameter at each end.

9. The image forming apparatus according to claim 1, wherein an axis center of the pressure roller is disposed on a downstream side of an axis center of the heating roller in the sheet transport direction.

10. The image forming apparatus according to claim 2, wherein the drawer case includes a plurality of photosensitive drums aligned from an upstream side to a downstream side of the sheet transport face in the sheet transport direction.

* * * * *